United States Patent [19]

Cooper

[11] Patent Number: 4,986,147

[45] Date of Patent: Jan. 22, 1991

[54] RATCHET WRENCH HAVING AN INTERNALLY REINFORCED HANDLE

[75] Inventor: Gerald C. Cooper, Tien Mou, Taiwan

[73] Assignee: National Hand Tool Corporation, Dallas, Tex.

[21] Appl. No.: 468,377

[22] Filed: Jan. 22, 1990

[30] Foreign Application Priority Data

Jul. 20, 1989 [TW] Taiwan ..... 78206877
Jul. 20, 1989 [TW] Taiwan ..... 78206878

[51] Int. Cl.[5] ..... B25B 13/46

[52] U.S. Cl. ..... 81/63.2; 81/177.1; 16/116 R

[58] Field of Search ..... 81/63.2 R, 177.1 X, 81/489, 492; 16/116 R, 110 R

[56] References Cited

U.S. PATENT DOCUMENTS 2,522,579 9/1950 Le Rette ..... 16/116 R
2,798,248 7/1957 Sladky et al. ..... 16/116 R
3,078,973 2/1963 Kilness ..... 81/63.2
3,393,587 7/1968 Jolliff et al. ..... 81/63.2
3,656,594 4/1972 Marks et al. ..... 16/116 R
4,070,932 1/1978 Jeannotte ..... 16/115

FOREIGN PATENT DOCUMENTS 1309952 5/1987 U.S.S.R. ..... 16/116 R

*Primary Examiner*—Frederick R. Schmidt
*Assistant Examiner*—Lawrence Cruz
*Attorney, Agent, or Firm*—Michael G. Berkman

[57] ABSTRACT

A ratchet wrench in which the body and an integrally formed handle are of molded plastics material. The body includes a head formed with an opening which contains the ratchet mechanism. A metal bar embedded in the handle during the plastics molding process substantially enhances the physical strength of the wrench, and metal clamp plates overlying and seated in recesses in opposed principal surfaces of the wrench are bolted to each other, and are coupled to internal core components in the head of the wrench to secure the ratchet mechanism in place. The metal bar in the handle imparts structural stability and integrity as well as increased mechanical strength to the composite assembly.

12 Claims, 3 Drawing Sheets

RATCHET WRENCH HAVING AN INTERNALLY REINFORCED HANDLE

FIELD OF THE INVENTION, AND BACKGROUND

The present invention relates to a ratchet wrench having structural components which include both metals and plastics compositions. More particularly, the invention is directed to a ratchet wrench having a plastics body and handle with cooperating reinforcing and augmenting outer metal plate structures as well as a metal bar contained within the molded wrench body and the wrench handle.

Ratchet wrenches with bodies or body components of plastics material are not unknown in the art, and such tools have take various forms and structural arrangements. In some of these tools, mechanical strength has been sacrificed or compromised to achieve weight reduction and to reduce production costs. In others, the adoption of plastics as a structural medium has not been without a sacrifice of durability and functional reliability. The recognized advantages inherent in the adoption of plastic as a structural medium in a fabrication of tools such as ratchet wrenches notwithstanding, no completely satisfactory composite structural assembly has heretofore been devised. It is, therefore, a principal aim of the present invention to provide a ratchet wrench having a body, including a head portion and a handle of plastics composition, in combination with outer and internal metal components so that functional reliability and structural strength are ensured and shortcomings and inadequacies of prior art devices are obviated.

SUMMARY OF THE INVENTION

The present invention pertains to a ratchet wrench having a body and integrally formed head portion and handle of molded plastics composition and which is strengthened mechanically by providing a metal bar encased in the handle itself during the molding step. Metal plates embedded in and secured to the body of the wrench overlie opposed principal sides of the wrench head and body and extend into the handle zone. These plates serve to intercouple and to fix the core assembly with the wrench. Additionally, they engage the encased bar so as to establish an exceedingly strong and a mechanically stable operative structure.

It is a feature of the invention that the core or ratchet assembly, including a toothed wheel and drive-reversing pivotal pawl, is seated in and functionally supported within and held fixed in a head zone of the plastics body of the wrench.

A related feature of the wrench of the invention is that the metal reinforcing or clamping plates on opposite sides of the wrench are seated in zonal areas which are recessed somewhat so that the outer surfaces of the plates and the outer bounds of the wrench body and integrally formed handle lie in the same plane, thereby effecting a strengthening of the structure and contributing to the overall aesthetics and enhancing the appearance of the wrench.

Yet another feature of the wrench is that the hand grip section of the molded handle is formed with arrays of slots or slot ways opening outwardly of the handle to ensure positive and comfortable grasping of the handle manually.

It is a feature of the wrench of the invention that it includes an end-rounded head with side walls tapering or sloping inwardly to blend into a laterally narrowed intermediate or mid-zone. The latter joins a somewhat enlarged hand grip section having a generally oval or ellipsoid cross-section and tapering inwardly at its lower extremity. The described configuration contributes to an overall appearance which is aesthetically pleasing while providing a structure which at the same time suggests (and provides) great strength, reliability in use, and which contributes to functional effectiveness.

In a preferred embodiment of the invention the plastics composition is reinforced and strengthened through the incorporation of fibrous material such as glass fibers dispersed in the plastics material and distributed throughout.

An important structural feature of the wrench is that the head portion, the handle or grip section and the intermediate zone are integrally formed in a single molding step or operation.

A related feature of the invention is that the internal metal reinforcing bar is supported in place and is encased within the wrench during the molding step.

The ratchet wrench of the invention includes a conveniently operable, drive-direction-reversing, pivotally-mounted lever and a quick release push-button for easy socket removal or separation.

An important advantage of the wrench of the invention, as compared with its all-metal counterparts, is that the requirement for costly and time consuming forging and machining of the wrench body including a knurling of the handle, is obviated.

Other advantages of the wrench, in use are its reduced weight and that it can be handled with enhanced physical comfort to the use, the wrench also being less prone to harboring and retaining objectionable extremes in sensed temperature.

It is an important practical and economic characteristic of the invention that it is easily assembled, and that without compromising utilitarian excellence, it lends itself to efficient and more economical mass production, and at overall costs which are less than for many prior art wrench structures.

In preferred embodiments of the invention the material used in fabrication of the wrench is of a solvent and corrosion resistant, high-strength, impact-resistant, fiber-reinforced plastics material such as a polyamid (e.g. Nylon) or a polyester, polycarbonate, or a polyurethane.

It is a feature of the ratchet wrench of the invention that a common, prior-art practice of encasing the metal handle within a wrap-around sleeve of rubber or plastics composition is rendered unnecessary.

Other and further objects, features and advantages of the invention will be evident upon a reading of the following specifications taken in conjunction with the drawing.

DESCRIPTION OF THE ILLUSTRATED EMBODIMENT

Figure 1:
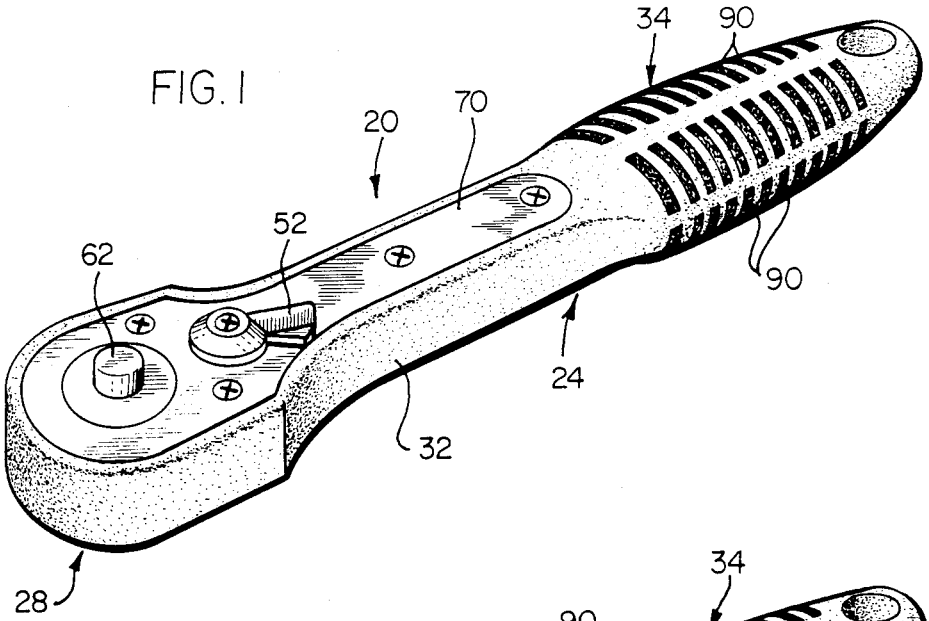
FIG. 1 is a perspective view of the ratchet wrench of the invention, embodying the features thereof, and showing a top principal face of the wrench.
Figure 2:
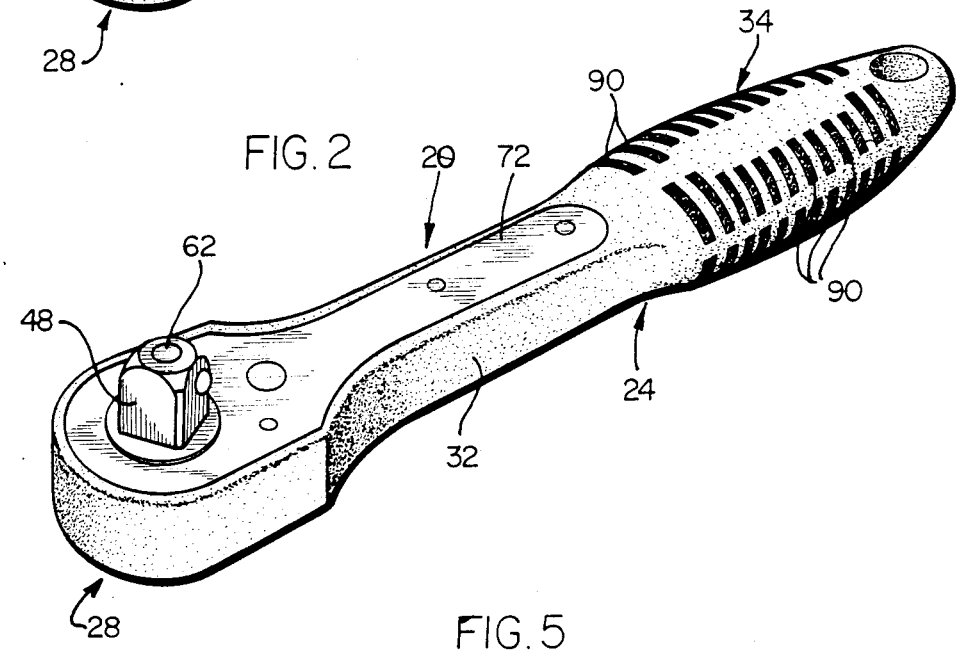
FIG. 2 is a view similar to FIG. 1, but showing an opposite principal face.

The aims and objects of the invention are accomplished by providing, in a reversible drive ratchet wrench, a unitary body and handle assembly of a molded, reinforced, plastics composition including an upper or head portion housing a ratchet mechanism including a shiftable toothed pawl and a cooperating toothed wheel. The wrench is formed with a lower handle section and an intermediate section interposed between and interconnecting the head portion with the handle. Embedded in the body of the wrench and extending longitudinally from the handle zone to adjacent the head is an elongated metal bar which imparts substantial mechanical strength to the wrench. Metal clamp plates overlying and recessed into the wrench faces at opposed top and bottom principal surfaces thereof are coupled to internal ratchet elements in the ratchet wrench head, to the encased bar, and to one another, thereby establishing a unitary functional structure characterized by enhanced mechanical strength and stability and providing a visually pleasing overall aesthetic appearance. A tool-engaging stud or boss coupled to the head-housed driven ratchet wheel extends laterally from the head of the tool, and a spring-biased, digitally-depressible button projecting from the tool head provides a quick release of the stud-carried tool element.

Referring now to the drawings, and particularly to FIGS. 1 through 4, there is shown, for illustrative purposes and not in any limiting sense, one preferred embodiment of the ratchet wrench of the invention incorporating the features thereof.

In the specific example of the invention depicted, a reversible drive ratchet wrench 20 is shown as having an integrally-formed, unitary body 24 of a molded plastics composition. The body 24 includes a ring-like head portion 28 generally oval in configuration, an intermediate constricted zone 32 of a generally cylindrical form, and an enlarged, contoured handle 34 preferably somewhat ellipsoid in transverse section. In a preferred embodiment of the invention, reinforcing fibers such as glass fibers 36 are distributed throughout the plastics composition (FIG. 5).

Figure 5:
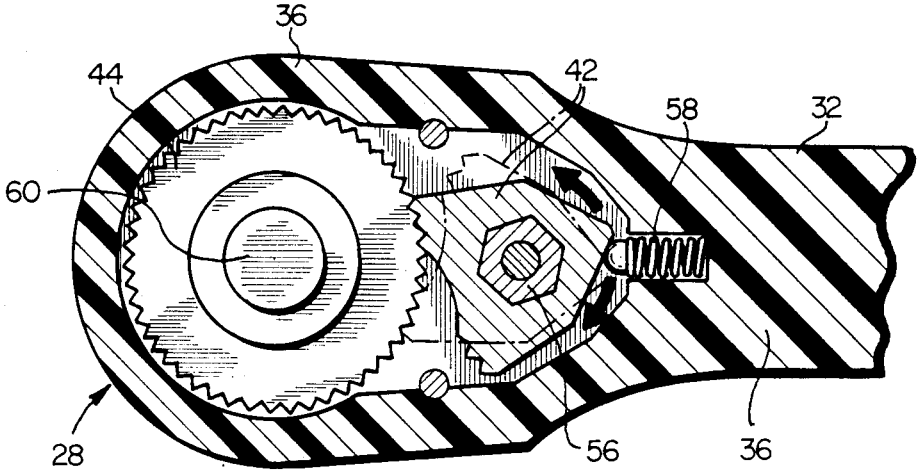
FIG. 5 is an enlarged cross-sectional view taken substantially on the liens 5—5 of FIG. 4 and showing the ratchet pawl and drive wheel of the wrench.
Figure 3:
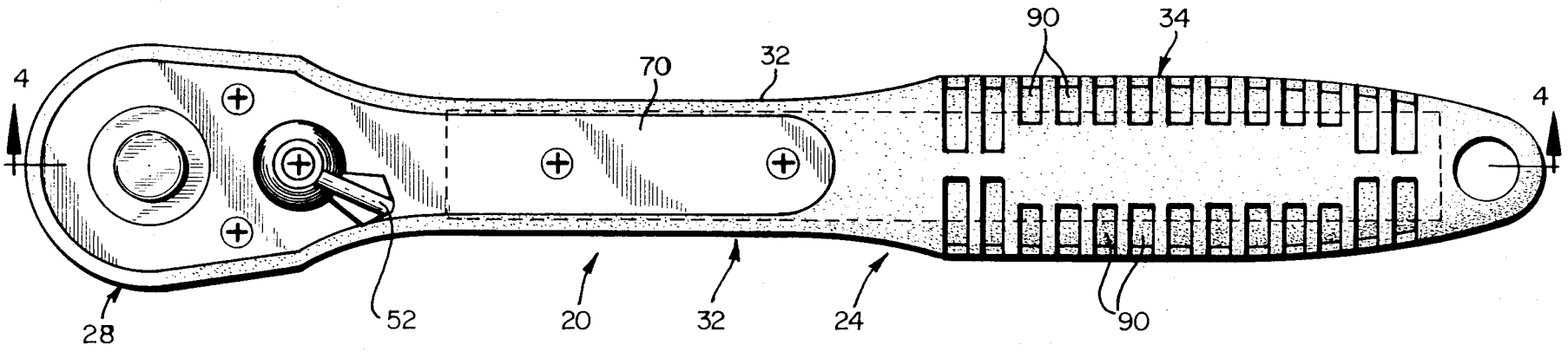
FIG. 3 is an enlarged top view of the ratchet wrench.
Figure 4:
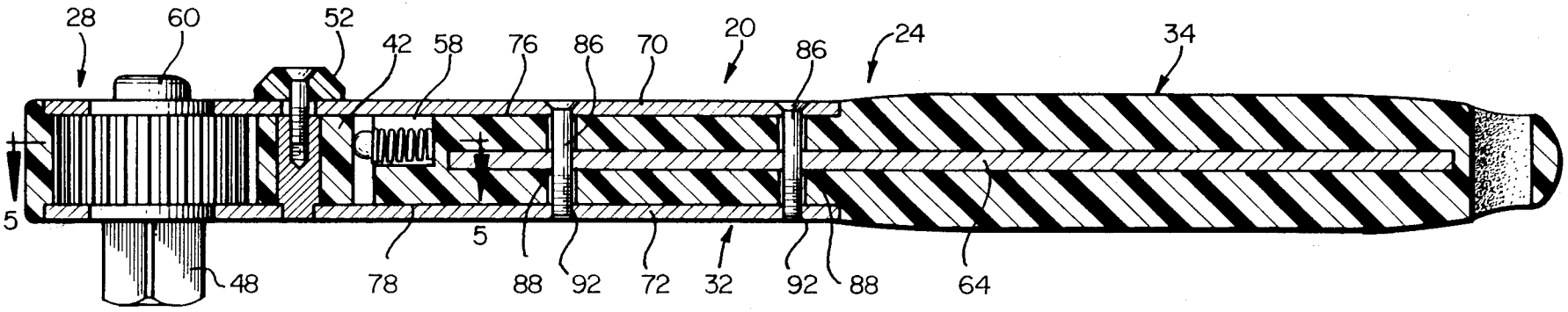
FIG. 4 is a cross-section view taken substantially on the lines 4—4 of FIG. 4 and showing the reinforcing bar embedded in the body of the wrench, and the clamping plates.
Figure 6:
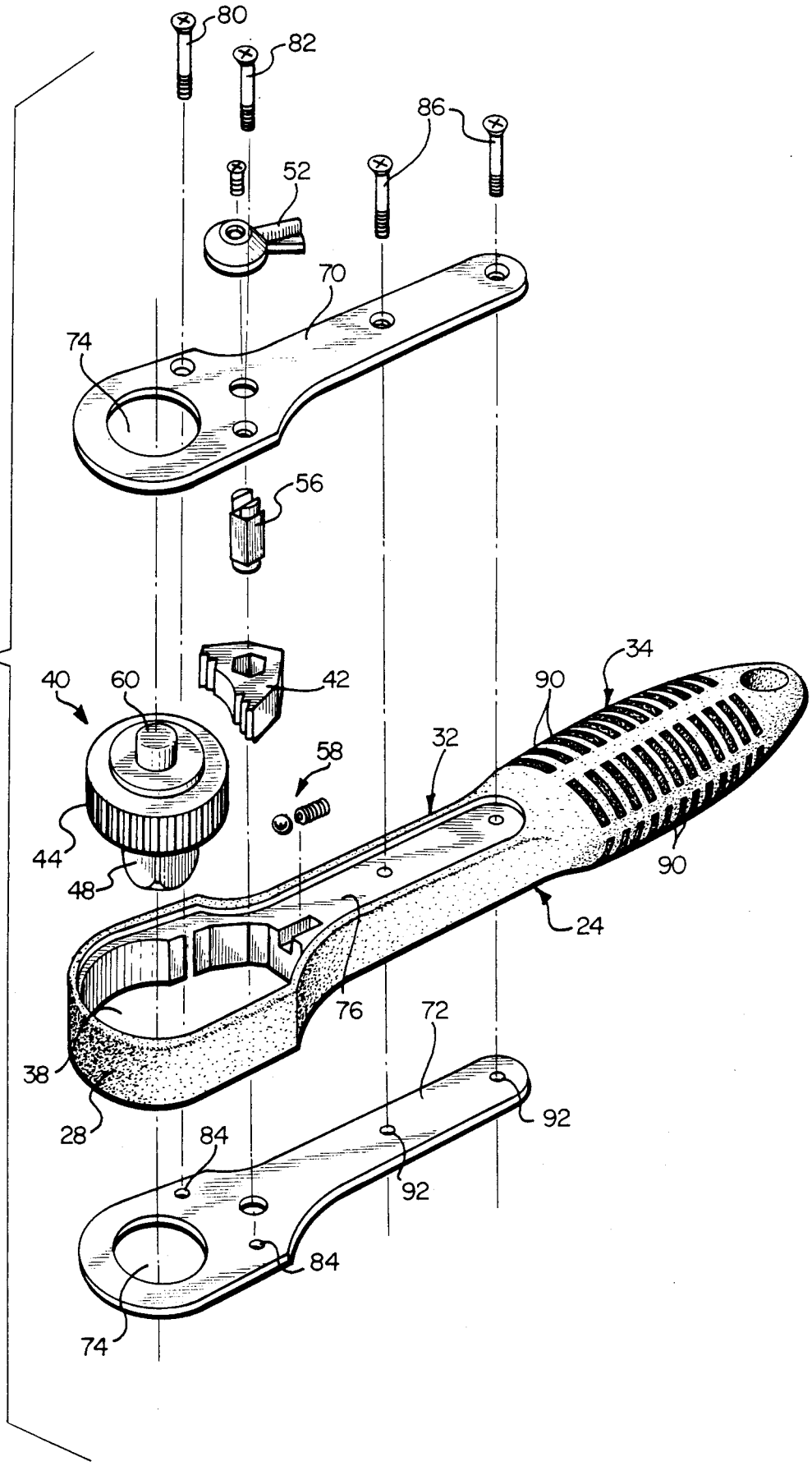
FIG. 6 is an exploded, perspective view depicting, schematically, the structure and component elements of the wrench.

The head 28 of the wrench 20 is molded to define a through opening 38 constituting a housing or chamber for a ratchet drive assembly 40 which includes a toothed, pivotally-mounted pawl 42 and a cooperating externally toothed drive wheel 44 (FIG. 5).

The drive wheel 44 is integrally formed with or otherwise firmly joined to a driving boss or stud 48 projecting laterally outwardly of the head 28 of the wrench for attachment of tool elements (not shown) thereto. A pawl-positioning and reversing lever 52 keyed to the pawl 42 through a shaft 56 overlies and is secured to the head 28 of the wrench for digital manipulation to control the drive direction of the tool. A spring and ball assembly 58 confined in the wrench at its head 28 bears upon the pawl 42 to retain it in either of its two functional drive modes.

A digitally depressible, spring-biased button 60 connected to a shaft 62 extending through the tool head 28 and into the stud 48 provides a quick release of a stud-carried tool element, in a manner well known in the art.

Embedded in the wrench (during the molding of the plastics composition) is a metal bar 64 which extends longitudinally within the body 24 from a position near the head 28 downwardly and well into the handle 36 as a mechanical reinforcement of the wrench 20.

Auxiliary structural components contributing to the overall mechanical strength and structural integrity of the ratchet wrench include a pair of metal plates 70 and 72 which overlie the body 24 of the wrench 20 on each of opposed sides thereof in an area embracing the head portion 28 and extending into the intermediate zone 32 and the handle area itself. In the embodiment of the wrench shown, the plates 70 and 72 follow generally the bounding contour of the wrench and are seated within recessed zonal areas 76 and 78 preformed in the molded component of the wrench 20. The recessed areas 76 and 78 are shaped in congruence with perimetric outlines of the plates 70 and 72 and the depth of the recessed areas is preferably such that the top faces of the plates 70 and 72 are coplanar with outer bounds of the molded plastic body 24 of the wrench 20 (FIGS. 1–4 and 6).

The plates or clamp plates 70 and 72, seated in the wrench body 24, are formed, in the head portion 28 of the wrench 20 with through openings 74 for accommodating the release button 60 at one side of the wrench head 28 and the drive stud 48 and an opposite side. Headed bolts 80 and 82, extending through holes formed in the upper one 70 of the plates 70 and 72 extend through the wrench head 28 and threadedly 84 engaging the lower plate 72 hold the clamping plates 70 and 72 positively and firmly in place and fixing the ratchet assembly 40 in a secured position within the wrench head 28.

Headed bolts 86 extending through the clamp plate 70 and through the body of the wrench in a zone adjacent the handle 34 passes through pre-formed holes 88 in a reinforcing bar 64 and threadedly 92 engage the lower clamp plate 72, further to secure the plates 70 and 72 in place and to impart additional stability to the reinforcing bar 64 in the wrench body 24.

In a preferred embodiment of the invention, the handle 34 is integrally formed with arrays of slots or slotways 90 opening outwardly of the handle for ensuring positive and comfortable grasping of the handle manually.

It will be appreciated that the wrench of the invention may be readily disassembled for cleaning or maintenance by careful removal of the bounding plates 70 and 72.

While the invention has been described with reference to a specific preferred embodiment, it will be appreciated that many changes, not rising to the level of invention, may be made without departing from the spirit of the invention or the scope as defined in the appended claims.

What is claimed is:

1. In a ratchet wrench having a tool head including a driving ring, a core rotatably journaled in said drive ring, selectively positionable pawl means coupled to said drive ring for controlling drive direction of said drive ring during use of said wrench, stud-like boss means connected to and extending downwardly from said core for attachment of interchangeable tool elements thereto, handle means extending from said tool head for manually transferring forces between said pawl and said drive ring for drivingly rotating said core and said boss means extending therefrom.

the improvement wherein said wrench has a body having hand-grip handle means and body means extending between said handle means and a head integrally formed therewith, said body being molded of a high-strength plastics material with reinforcing means embedded therein for further strengthening said wrench, said body of said wrench being integrally formed at a driving end head zone of said wrench with a through opening for accommodating said core seated therewithin, and wherein said reinforcing means includes bar means embedded in and extending longitudinally in said body including said handle means for imparting enhanced mechanical strength thereto.

2. The improvement as set forth in claim 1, wherein said head, said body and said handle means are integrally injection molded and further comprising fiber means distributed throughout said plastics material for enhancing mechanical strength characteristics thereof.

3. The structure as set forth in claim 1, wherein said handle means is integrally formed in a hand grip section thereof with grip-enhancing slot means for ensuring positive grasping of said handle means manually, said slot means being distributed as an array along a hand-gripping lineal sector of said handle means and opening outwardly thereof.

4. The structure as set forth in claim 2, wherein said handle means is shaped to provide a generally oval cross-section.

5. The structure as set forth in claim 1, in which said bar means embedded in said body and said handle means defines a principal plane which parallels a plane in which said core rotates in use.

6. The structure as set forth in claim 1, wherein said wrench is formed with recessed areas in upper and in lower faces of said tool head and said tool body, said recessed areas being shaped to accommodate said plate means therewithin, and said recessed areas being of a depth to establish a top surface of said plate means and a laterally adjacent surface of said tool body as a common plane when said plate means are seating in said recessed areas.

7. The structure as set forth in claim 1, and further comprising plate means overlying said tool head and said body, and secured to said tool head and said body on opposed principal sides thereof for enhancing the strength of said wrench.

8. The structure as set forth in claim 7 and further comprising bolt means for securing said plate means to said tool head and to said body.

9. The structure as set forth in claim 6, wherein said plate means extends from said tool head end of said wrench to a hand grip sector of said handle means.

10. The structure as set forth in claim 8, wherein said bar means is formed with through bores in alignment with said bolt means for receiving said bolt means therethrough.

11. The structure as set forth in claim 7, wherein said plate means are formed with openings for receiving upper and lower end portions of said rotatable core of said wrench therethrough.

12. The structure as set forth in claim 7 and further comprising shaft means keyed to said pawl means for manipulation of said pawl means to control a drive direction thereof, and wherein said plate means are formed with openings for receiving opposed ends of said shaft means therethrough.

* * * * *